US012709850B2

(12) United States Patent
Fraser

(10) Patent No.: US 12,709,850 B2
(45) Date of Patent: Aug. 18, 2026

(54) MARINA

(71) Applicant: Mark Andrew Fraser, Queensland (AU)

(72) Inventor: Mark Andrew Fraser, Queensland (AU)

( * ) Notice: Subject to any disclaimer, the term of this patent is extended or adjusted under 35 U.S.C. 154(b) by 93 days.

(21) Appl. No.: 18/683,206

(22) PCT Filed: Aug. 12, 2022

(86) PCT No.: PCT/AU2022/050885
§ 371 (c)(1),
(2) Date: Feb. 12, 2024

(87) PCT Pub. No.: WO2023/015357
PCT Pub. Date: Feb. 16, 2023

(65) Prior Publication Data

US 2025/0129561 A1 Apr. 24, 2025

(30) Foreign Application Priority Data

Aug. 13, 2021 (AU) ..... 2021105432

(51) Int. Cl.
*E02B 3/06* (2006.01)

(52) U.S. Cl.
CPC ..... *E02B 3/068* (2013.01); *E02B 3/064* (2013.01)

(58) Field of Classification Search
CPC ..... E02B 3/064; E02B 3/068; B63C 1/02
See application file for complete search history.

(56) References Cited

U.S. PATENT DOCUMENTS

| | | | | | |
|---|---|---|---|---|---|
| 3,329,117 | A | | 7/1967 | Meeusen | |
| 3,659,540 | A | * | 5/1972 | Toby | B63B 35/34 114/266 |
| 4,940,021 | A | * | 7/1990 | Rytand | E02B 3/064 114/263 |
| 5,056,452 | A | * | 10/1991 | McCain | E02B 3/064 114/263 |
| 9,206,570 | B2 | * | 12/2015 | Knight | B63B 35/38 |
| 9,206,571 | B2 | * | 12/2015 | Marantier | E02B 3/064 |
| 2005/0268836 | A1 | | 12/2005 | Brine | |

(Continued)

FOREIGN PATENT DOCUMENTS

| | | | | | |
|---|---|---|---|---|---|
| AU | 2007266832 | A1 | * | 12/2007 | E02B 3/064 |
| CN | 1642807 | B | * | 9/2012 | B63B 35/34 |
| DE | 2514965 | A1 | | 10/1976 | |

(Continued)

OTHER PUBLICATIONS

PCT Int'l Search Report and Written Opinion dated Oct. 17, 2022 issued in connection with related PCT/AU2022/050885, 9 pages.

(Continued)

*Primary Examiner* — Frederick L Lagman
(74) *Attorney, Agent, or Firm* — Brooks Kushman P.C.

(57) ABSTRACT

The present invention relates to a marina. The marina includes a spine. Vessel berths extend along the spine and are configured to enable vessels to berth obliquely to the spine. Advantageously, the vessels may be berthed obliquely to the spine, avoiding tight 90° turns, for safer berthing of the vessels. The berths may be reconfigured to accommodate vessels of different size, on a needs basis, for improved berthing efficiency.

18 Claims, 3 Drawing Sheets

(56) References Cited

U.S. PATENT DOCUMENTS

| | | | | |
|---|---|---|---|---|
| 2012/0326882 | A1* | 12/2012 | Behm | G01S 1/7034 362/477 |
| 2014/0245940 | A1* | 9/2014 | Marantier | B63B 35/38 114/263 |

FOREIGN PATENT DOCUMENTS

| | | | | | |
|---|---|---|---|---|---|
| KR | 20130142261 | A | | 12/2013 | |
| KR | 20140013144 | A | * | 2/2014 | E02B 3/064 |
| WO | WO 1992/002407 | A1 | | 2/1992 | |

OTHER PUBLICATIONS

Australian Examination Report dated Nov. 8, 2021 issued in connection with Australian patent application No. 2021105432, 6 pages.

* cited by examiner

MARINA

CROSS-REFERENCE TO RELATED APPLICATIONS

This application is the U.S. national phase of PCT Appln. No. PCT/AU2022/050885 filed Aug. 12, 2022, which claims priority to Australian Application Serial No. 2021105432 filed Aug. 13, 2021, the disclosures of which are hereby incorporated in their entirety by reference herein.

TECHNICAL FIELD

The present invention relates to a marina.

BACKGROUND

The reference to any prior art in this specification is not, and should not be taken as an acknowledgement or any form of suggestion that the prior art forms part of the common general knowledge.

A marina is typically used to berth marine vessels such as pleasure craft and small boats.

FIG. 1 shows a known marina 100. The marina 100 includes a wharf 102, and straight parallel pier spines 104 extending from the wharf 102. Vessel berths 106 extend along each spine 104 and enable boats 108 to berth orthogonally to the spine 104 and parallel to the wharf 102.

In practice, most damage to boats 108 occurs within the marina 100, especially when weekend skippers berth or depart. The skipper is required to make a 90° turn, often during tidal movement and wind and at slow speed. Boats 108 travelling at slow speed are extremely hard to maneuver, and so skippers often berth the boat 108 by reversing in, with some pace, then apply forward thrust to slow and stop. The mouth gap between partitioning ribs 112 of each berth 106 is typically 1.5 times the length of a boat—so right-angled berthing is tight and fraught with danger under speed.

The preferred embodiment provides a marina for safer berthing of the boats 110.

In constructing the pier spines 104, the developers of the marina 100 need to decide the size of boats 108. Each pier spine 104 will accommodate, typically 10 m, 12 m, 15 m, 20 m etc boat lengths, and all berths 106 along that pier spine 104 are that size and cannot be altered. Any alteration would mean basically rebuilding the pier spine 104 and relocating the piles etc. Often, over time, the length of boats 108 in fashion can change so marina operators find themselves with too many boats 108 of one size and too little of another. Income and berthing rates are charged, and typically depend upon the boat length.

The traditional marina 100 is also not overly efficient (number of boats/$m^2$ of marina area) due to the need to have a wide enough berth gap for the longest boat 108 to turn. FIG. 1 can typically berth 324 boats on 507,000 $mm^2$ of marina area.

The preferred embodiment provides for improved berthing efficiency.

SUMMARY OF THE INVENTION

According to one aspect of the present invention, there is provided a marina including:

a spine; and vessel berths extending along the spine and for enabling vessels to berth obliquely to the spine.

Advantageously, the vessels may be berthed obliquely to the spine, avoiding tight 90° turns, for safer berthing of the vessels. The berths may be reconfigured to accommodate vessels of different size, on a needs basis, for improved berthing efficiency.

The vessels may berth obliquely to a longitudinal central axis of the spine. Preferably, the vessels can berth at between about 30° and 60°, and even more preferably about 45° to the spine. The spine may be zig-zagged or corrugated in shape.

The spine may include a major walkway. Each berth may include a pair of minor walkways extending from the spine. The minor walkways may be lower than the spine.

The berths may be located on either side of the spine. The berths may include a pair of parallel ribs extending from the spine. Each rib may be aligned with a straight portion of the spine. Each rib may include a floating pontoon. Each rib may be adjustable relative to, or along, the spine to accommodate vessels of different size. The berths may have an internal perimeter defined by three straight edges. The berths may have squarish portions proximal the spine.

Each berth may include a docking bay. Each berth may berth a respective vessel. Each berth may berth a pair of vessels. Each berth may berth three vessels with an intervening rib.

The marina may include a wharf from which the spine extends, preferably orthogonally. The spine may include a pier. The spine may include a floating pontoon. The marina may include a herringbone pattern.

According to another aspect of the present invention, there is provided a method for berthing a vessel at a marina, the method including:

receiving the vessel in a vessel berth so that the vessel is berthed obliquely to a spine and/or wharf.

The method may involve adjusting a vessel partitioning rib along the spine.

According to another aspect of the present invention, there is provided a marina including:

a wharf;

one or more spines extending from the wharf; and vessel berths extending along each spine and for enabling vessels to berth obliquely to the spine and/or wharf.

The wharf may define protrusions from which respective spines extend. The wharf may define cutouts to receive vessels. The marina may also include bumpers terminating respective spines.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 2:
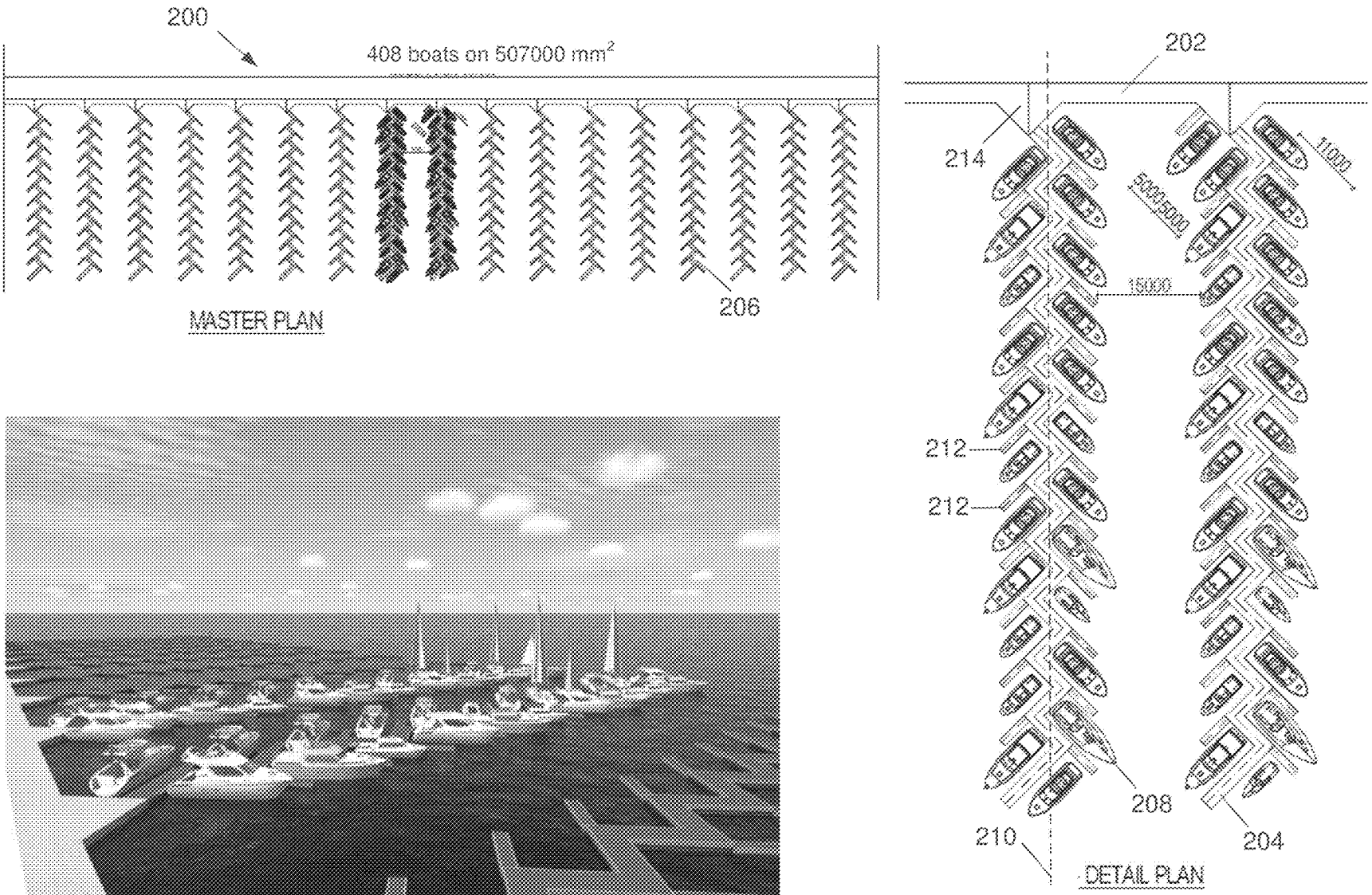
FIG. 2 shows a marina in accordance with an embodiment of the present invention.

According to an embodiment of the present invention, there is provided a herringbone boat marina 200 as shown in FIG. 2. The marina 200 includes a substantially straight wharf 202. Pier spines 204 extend perpendicularly from the wharf 202. Boat berths 206 extend along both sides of each elongate spine 204. The berths 206 are configured to enable respective boats 208 (i.e. marine vessels) to berth obliquely to both a central longitudinal central axis 210 of the spine 204 and the wharf 202.

Figure 1:
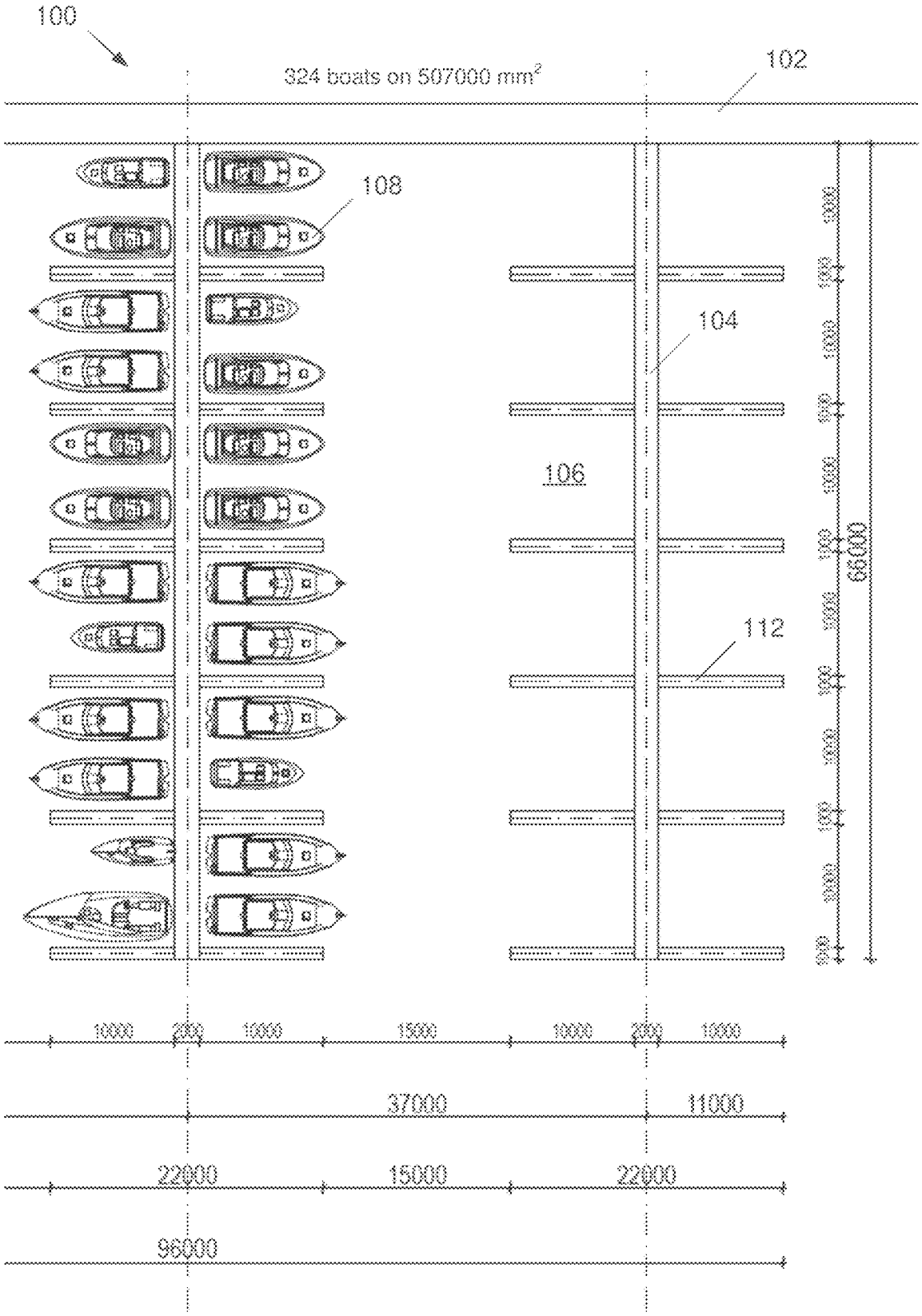
Figure 1 (Prior Art)
FIG. 1 is a schematic view of a known marina, with dimensions in millimeters.

Advantageously, the boats 208 can be reversed-in and berthed obliquely to the spine 204, avoiding tight 90° turns, for safer berthing of the boats 208. The marina 200 can typically berth 408 boats on 507,000 $mm^2$ of marina area, which is far more efficient (20%) when compared with the marina 100 of FIG. 1 which can typically only berth 324 boats on 507,000 $mm^2$ of marina area.

The central spine 204 is zig-zagged or corrugated in shape, with intersecting orthogonal portions, and enables the boats 208 to berth at about 45° to the spine 204 and wharf 202. Each berth 206 forms a docking bay with a pair of parallel ribs 212 extending from the spine 204. Each straight rib 212 is aligned with a straight portion of the zig-zagged spine 204. The berths 206 have an internal perimeter defined by three straight edges, and squarish water areas in which the boat 208 sit are formed proximal the spine 204.

Each spine 204 includes a major walkway. Each berth 206 includes a pair of minor walkways, formed by adjacent ribs 212 extending from the spine 204. The ribs 212 and minor walkways are floating pontoons located lower than the spine 204. The pier spine 204 is typically fixed on piles, but can also include a floating pontoon. The concrete wharf 202 is permanently fixed, and may define triangular protrusions 214 from which the spines 204 extend.

Figure 3:
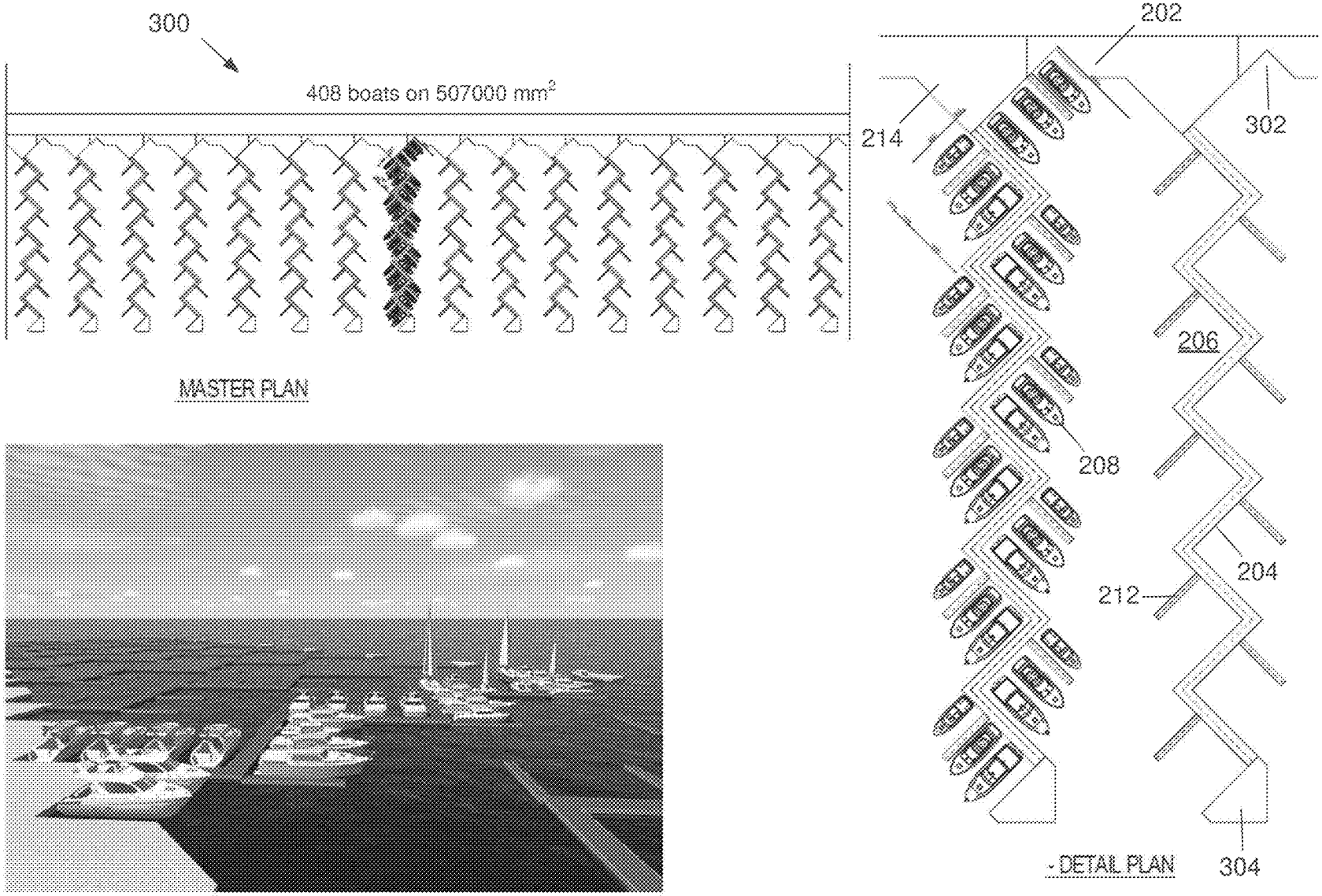
FIG. 3 shows a marina in accordance with another embodiment of the present invention.

FIG. 3 shows a similar herringbone boat marina 300 in accordance with another embodiment, also typically berthing 408 boats on 507,000 $mm^2$ of marina area. Each berth 206 can berth three boats 208, with an intervening rib 212 partitioning a pair of larger boats 208 in a docking bay from an outer smaller boat 208.

Each partitioning pontoon rib 212 is readily adjustable along the spine 204, or removed, so that the berths 206 can be reconfigured to accommodate boats of different size, on a needs basis, for improved berthing efficiency. The marina 300 allows a greater flexibility in layout and size of the boats 208 on each pier spine 204, and is not limited to just the one sized berth 206.

The wharf 102 defines cutouts 302 to receive boats 208. The marina 300 can also include tapered bumpers 304 terminating respective spines 204. The berths in FIG. 3 are of comparable size to those in FIG. 1.

A method for berthing a boat 208 at the marina 300 is briefly described.

Initially, the rib 212 can be adjust along the spine 204 for preferred configuration based upon the boat 208.

Next, the boat 208 is reversed along the spine 204 and received in a required boat berth 206 so that the boat 208 is berthed obliquely to the spine 204 and the wharf 202. Boats 208 can be reversed in at a faster pace than the marina 100 of FIG. 1, and the skipper need only swing the bow around by 45 degrees.

The boat 208 can simply depart forwards from the berth 206.

A person skilled in the art will appreciate that many embodiments and variations can be made without departing from the ambit of the present invention.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. A marina including:

a spine that is zig-zagged or corrugated in shape; and vessel berths extending along the spine and for enabling vessels to berth obliquely to the spine;

wherein each berth includes at least one rib extending from a single side of the spine.

2. A marina as claimed in claim 1, wherein the vessels are berthed obliquely on either side of the spine to form a series of chevrons, avoiding tight 90° or acute turns, for safer berthing of the vessels.

3. A marina as claimed in claim 1, wherein berths are independently reconfigured to accommodate vessels of different size, on a needs basis, for improved berthing efficiency.

4. A marina as claimed in claim 1, wherein the vessels berth obliquely to a longitudinal central axis of the spine facing away from a wharf from which the spine extends.

5. A marina as claimed in claim 1, wherein the vessels berth at between about 30° and 60° to the spine, or about 45° to the spine.

6. A marina as claimed in claim 1, wherein the spine is-includes orthogonally arranged sections giving the zig-zagged or corrugated in shape.

7. A marina as claimed in claim 1, wherein the spine includes a major walkway and the rib includes an independent minor walkway.

8. A marina as claimed in claim 1, wherein each rib is lower than the spine.

9. A marina as claimed in claim 1, wherein each berth includes a pair of parallel and independent ribs extending from a single side of the spine.

10. A marina as claimed in claim 1, wherein each rib is aligned with a stepped portion of the spine.

11. A marina as claimed in claim 1, wherein each rib includes a floating pontoon.

12. A marina as claimed in claim 1, wherein each rib is independently adjustable relative to, or along, the spine to accommodate vessels of different size and the berths are of different configurations.

13. A marina as claimed in claim 1, wherein each berth has an internal perimeter defined by three orthogonal edges, the edges obliquely aligned with a wharf from which the spine extends.

14. A marina as claimed in claim 1, wherein the berths are located on either side of the spine and misaligned, each berth including a docking bay with a squarish portion proximal the spine.

15. A marina as claimed in claim 1, wherein each berth berths a respective vessel, a pair of vessels or three vessels with an intervening rib.

16. A marina including:

a wharf;

one or more spines extending from the wharf; and vessel berths extending along opposite sides of each spine and for enabling vessels to berth obliquely to the spine and/or the wharf, the vessels not being berthed in parallel;

wherein the wharf defines protrusions from which respective spines extend and/or cutouts to receive vessels.

17. A marina as claimed in claim 16, wherein the marina includes bumpers terminating respective spines and/or a herringbone pattern.

18. A marina including:

a spine that is zig-zagged or corrugated in shape; and vessel berths extending along the spine and for enabling vessels to berth obliquely to the spine;

wherein each berth has an internal perimeter defined by three orthogonal edges, the edges obliquely aligned with a wharf from which the spine extends.

* * * * *